US006368080B1

(12) United States Patent
Sipin

(10) Patent No.: US 6,368,080 B1
(45) Date of Patent: Apr. 9, 2002

(54) CONTINUOUS FLUID INJECTION PUMP

(76) Inventor: Anatole J. Sipin, 221 E. 78th St., New York, NY (US) 10021

( * ) Notice: Subject to any disclaimer, the term of this patent is extended or adjusted under 35 U.S.C. 154(b) by 393 days.

(21) Appl. No.: 08/905,910

(22) Filed: Aug. 4, 1997

(51) Int. Cl.[7] ..... F04B 17/00
(52) U.S. Cl. ..... 417/415; 417/533; 417/539
(58) Field of Search ..... 417/415, 533, 417/539, 569; 137/512, 846

(56) References Cited

U.S. PATENT DOCUMENTS

| | | | | | |
|---|---|---|---|---|---|
| 1,325,398 | A | * | 12/1919 | Ellingson | 417/539 |
| 1,630,256 | A | * | 5/1927 | Cleage et al. | 417/569 |
| 2,138,605 | A | * | 11/1938 | Landis | 137/846 |
| 2,367,893 | A | * | 1/1945 | Sheen | 417/454 |
| 4,730,991 | A | * | 3/1988 | Handfield | 417/397 |

OTHER PUBLICATIONS

Vernay Laboratory Catalog on Duckbill valves, May 1979.*

* cited by examiner

*Primary Examiner*—Cheryl J. Tyler

(74) *Attorney, Agent, or Firm*—Hedman & Costigan, P.C.

(57) ABSTRACT

A continuous fluid injection pump delivers a constant flow of fluid under variable loads. This pump includes a housing with an inlet, and outlet and a bore, an inlet line between the housing inlet and the bore, an outlet line between the housing outlet and the bore, a piston free to reciprocate the piston within the bore; a device to reciprocate the piston in a suction stroke and a pressure stroke, an inlet valve in the inlet line, the inlet valve being open when the piston is in a suction stroke to draw fluid into the bore through the inlet line, and closed when the piston is in said pressure stroke, an outlet valve in the outlet line, the outlet valve being open when said piston is in the pressure stroke to expell fluid from the bore into the outlet line, and closed when the piston is in said suction stroke, a sliding seal in contact with the piston to prevent fluid leakage, a flexible seal between the sliding seal and the reciprocating device, the flexible seal is connected at one end to the piston and at the other end to the housing to create an interior volume that isolates the fluid from the environment and prevents bacterial contamination.

2 Claims, 4 Drawing Sheets

CONTINUOUS FLUID INJECTION PUMP

BACKGROUND OF THE INVENTION

There has been an increasing interest in continuous, rotary (mostly centrifugal) blood pumps for circulatory assist and circulation maintenance. It has been reported that most patients who receive left ventricular assistance for treatment of postcardiotomy shock were supported by centrifugal pumps. Among the problems identified with displacement types of ventricular assist devices are infection, thrombosis and control. These problems could be reduced through the use of rotary pumps. Mechanical problems with existing centrifugal pumps result in infection caused by leakage through the shaft seal (direct drive) thrombosis caused by leaking seals and blood cell injury caused by bearings (magnetic drive).

To eliminate the problems with bearing seals, blood pumps for extracorporeal use have employed magnetic coupling. This, however, requires an additional bearing on the blood side, which increases the size of the assembly and could increase hemolysis. The increased size of the magnetic coupling handicaps the achievement of a small compact pump envelope for implantation. Because of these factors, development was undertaken on several implantable rotary blood pumps that mount the impeller directly on the motor shaft and use a rotating seal between the drive section and the blood pumping chamber. A purging liquid is introduced to wash the seal and to prevent thrombus formation.

Among rotary blood pumps intended for implantable circulatory assist devices, and for which purge liquid is required are the Baylor-Nikkiso centrifugal pump, the Nimbus axial flow pump (Axipump), an implantable centrifugal blood pump being developed at the Allegheny-Singer Research Institute and an intra ventricular axial flow pump being developed at the Japan Heart Institute.

The endurance of the Baylor-Nikkiso pump has been extended to two weeks' running, using saline as the purge liquid at flow rates between 3 and 7 ml/hr and pressures on the order of 300 mm Hg. In the Nimbus axial flow blood pump, 15 to 20 ml/day of 5% mixture of dextrose in water are been provided for lubrication of the bearing and blood seal. The purge liquid pressure at the rotating seal is approximately 1,000 mg Hg. Saline purge liquid at constant flow rates of 2 to a maximum of 10 ml/hr has been provided to the Singer-Allegheny Research centrifugal blood pump to lubricate the bearings and rotating seal at pressures of 500 mm Hg to 1,000 mm Hg.

There is a need for a simple, very small, wearable system that provides purge liquid to lubricate the bearings and protect the rotating seals of implanted rotary blood pumps, so as to permit safe and reliable operation of such pumps for medium-term and long term circulatory assist (e.g. three months to two years), including, for example a bridge for patients awaiting a transplant.

SUMMARY OF INVENTION

The invention is a continuous fluid injection pump to cause a constant flow of fluid through a variable comprising:

a housing with an inlet, an outlet and a bore, a inlet line between said housing inlet and said bore, an outlet line between said housing outlet and said bore, a piston free to reciprocate within said bore, means to reciprocate said piston in a suction stroke and pressure, stroke multiple one-way valves, series-connected in inlet or outlet lines so that the total compliance due to the valves will be reduced inversely to the number of valves and the total resistance to leakage flow will be increased directly to the number of valves to reduce lost piston stroke volume.

The primary application is in a purge system for a rotary blood pump comprising: a rotary pump with a rotary seal and bearings, a purge fluid pump connected to the said rotary pump to ingest liquid to purge said seal and bearings, and a non-orientation sensitive accumulator connected between said purge fluid pump and said rotary pump to maintain flow of purge fluid to said rotary pump when said purge fluid pump is disconnected.

DETAILED DESCRIPTION OF THE INVENTION

For application of the Continuous Fluid Injection Pump as a rotary blood pump purge liquid supply, a reciprocating piston displacement pump is desirable because of the requirement for constant flow delivery at very low flow rates and substantial pressures. Rotary gear or vane types of displacement pumps are not suitable at such very low flow rates. Although peristaltic roller pumps have been used in-vitro, it is difficult to conceive of this type as an ultra miniature wearable (and certainly not, ultimately, implantable) pump. Also, most of the energy is expended in squeezing the deformable flow tube, and the power requirements are excessive. Among the constraints on the design and operation of the reciprocating piston pump are: 1) The flow delivered to the rotary blood pump must be continuous to prevent backflow of blood through the rotating seal. 2) There must be adequate compliance in the system to accommodate any variations or interruptions in pump output; 3) The diameter of the piston should be small so as to minimize the pressure load and to provide reasonable values of piston velocity and drive motor speed, compatible with drive voltage levels and motor characteristics; and 4) lost displacement volumes should be small and compatible with the system compliance. For extended extracorporeal operation, volumes should be hermetically sealed to avoid infection.

Figure 1:
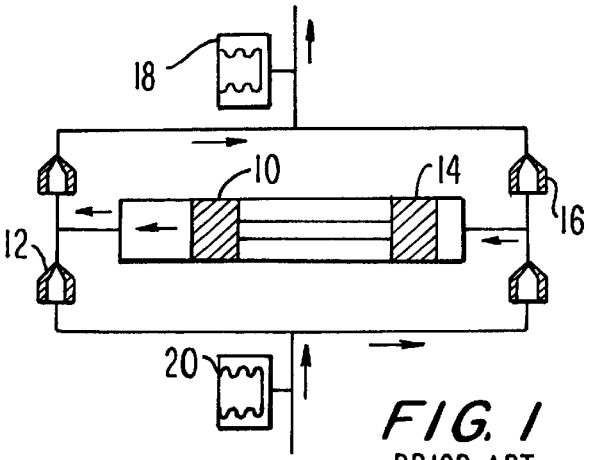
FIG. 1 PRIOR ART
FIG. 1 is a schematic diagram, illustrating the operation of a piston type of fluid injection pump, with single check valves in the inlet and outlet.

FIG. 1 is a schematic diagram of a double-acting piston pump with left and right pistons reciprocating at opposite ends of a common drive shaft. In FIG. 1, as the piston assembly moves to the left, the initial volume displaced by the left piston 10 will go to compress the closed left inlet check valve 12, and the volume drawn by the right piston 14, will come from compression of the closed right outlet valve 16, before liquid is delivered to the outlet against the outlet pressure. The lost volumes due to check valve compliance must be small compared to the stroke volume. They could be compensated by effective outlet and inlet accumulators, 18 and 20, whose function could be fulfilled by compliance of the system tubing. In experimental miniature diaphragm actuated wearable animal infusion pumps that have been built and tested excessive changes in stroke volume with pressure have been noted. These could be up to 40% of the piston stroke volume, which is undesirable. By supporting the walls of the check valves the lost volume could be reduced.

Figure 3:
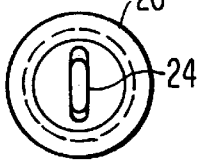
FIG. 3 is an end view of the cartridge shown in FIG. 2.
Figure 2:
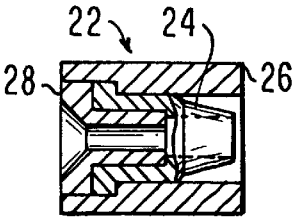
FIG. 2 is a sectional view of a cartridge assembly containing a preferred type of check valve used in the fluid injection pump.

The valve cartridge assembly 22 shown in FIG. 2 and FIG. 3 includes a molded elastomeric duckbill valve 24 assembled in a cylindrical housing 26. A valve insert 28 is used to clamp the valve flange 28A in place, and it also acts as a stiffener within the cylindrical inlet of the valve to prevent collapse of the cylindrical section with reverse pressure. The preferred duckbill 24 is flat, with parallel walls, and the transition is abrupt to reduce change in volume with reverse pressure.

Figure 4:
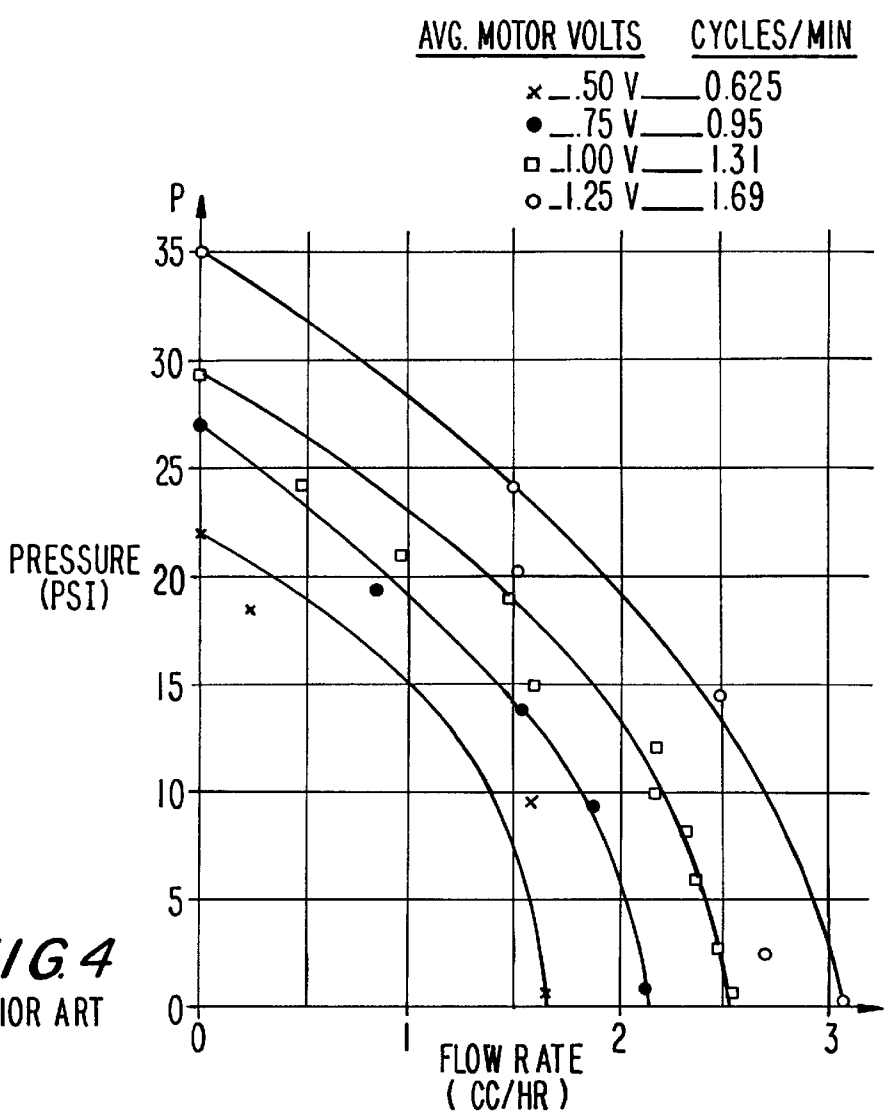
FIG. 4 PRIOR ART
FIG. 4 is a typical performance characteristic of a double-acting fluid injection pump with single check valves as shown in the schematic diagram of FIG. 1.

The performance characteristic shown in FIG. 4 was taken with a double-acting fluid injection pump with single check valves in the inlet and the outlet of the type shown in FIG. 2, which was calibrated at different values of pump speed.

The experimental pump characteristic shown in FIG. 4 is not as stiff as could be expected, and desired. For an ideal displacement pump, flow rate should be directly proportional to speed of the piston, and not affected by pressure, the motor stalling if the pressure limit is exceeded. The flattening of the characteristics as pressure increases indicates some compliance in the pumping chamber, either lost volume due to valve compression or a very high resistance was required to obtain the very low flow rate.

Analysis of the pump configuration has indicated that the undesirable flattening of the pump characteristic shown in FIG. 4 should be alleviated by the use of multiple check valves in the branch most affected by back pressure. When the pump is connected as a pressure pump, with the inlet connected to a low gauge pressure source and the outlet connected to a high positive pressure sink and/or a high resistance load, the affected branch will be the pump inlet. When the pump is connected as a suction pump, with the inlet connected to a negative pressure source and/or a high resistance load and the outlet connected to a low gauge pressure sink, the affected branch will be the pump outlet. Lost volume will be experienced in the affected branch in either case due to reverse valve compliance or valve leakage. With multiple check valves in the affected branch the overall reverse compliance will be inversely related to the number of series-connected valves. The resistance to leakage flow will be directly related to the number of series-connected valves. The number of series connected valves to be used will depend on the operating pressures, the required level of overall compliance, the tolerable leakage, geometrical limitations and cost considerations.

Figure 5:
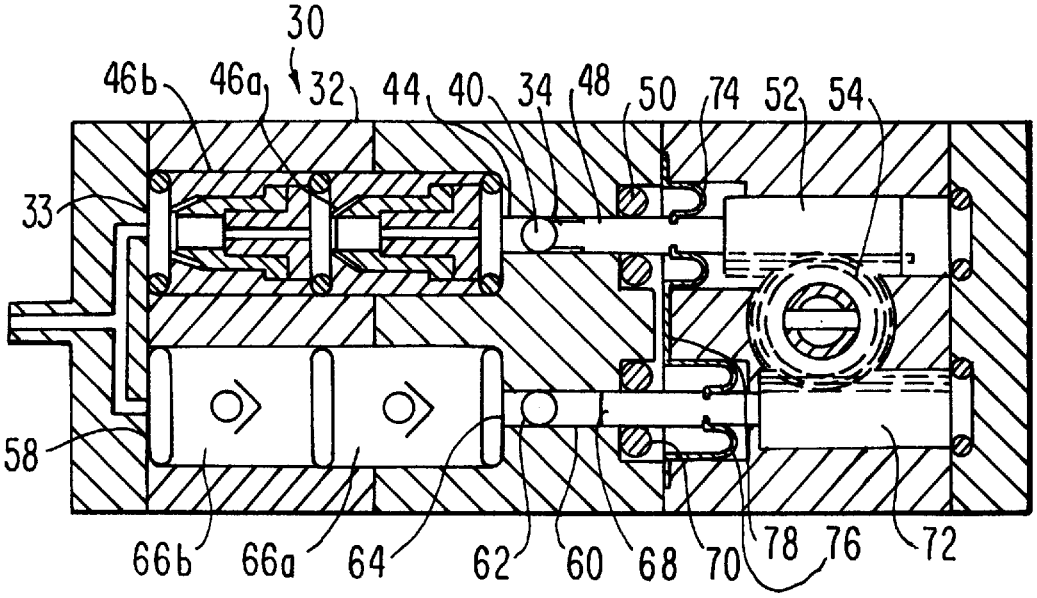
FIG. 5 is an assembly drawing of a replaceable pumping module for a fluid injection pump with two pistons, incorporating dual in-line check valve assemblies for the inlets and outlets of both pistons.

An assembly drawing of a replaceable pumping module for a fluid injection pump with two pistons is shown in FIG. 5 The design incorporates dual in-line check valve assemblies for the inlets and the outlets of both pistons. A coarse screen (not shown) is placed at the inlet to each valve assembly to remove any large particles that might accidentally enter the system.

Figure 6:
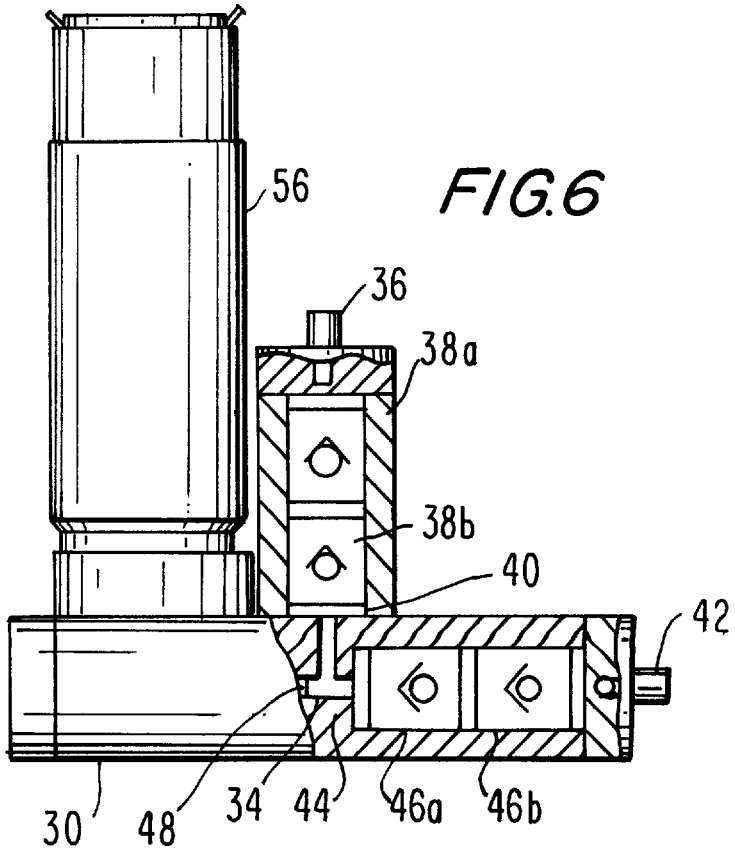
FIG. 6 is an outline drawing of an assembled fluid injection pump that consists of the replaceable pumping module with dual in-line check valves shown in FIG. 5 and a driving gear motor.

As shown in FIG. 5 and FIG. 6, replaceable pumping module 30, includes a housing 32 that contains a first pump 33 comprising a bore 34 which communicates with an inlet 36 through a tandem pair of series-connected inlet check valves, 38*a* and 38*b* and a passage 40. Bore 34 also communicates with an outlet 42 through a passage 44 and a tandem pair of series connected outlet check valves 46*a* and 46*b*, (here represented as the check valve assembly shown in FIG. 2 for purpose of illustration). A piston 48 reciprocates in bore 34, the rear end of piston 48 drawing fluid into bore 34 through passage 40 during a suction stroke, and expelling fluid from bore 34 through passage 44 during a pressure stroke. Piston 48 is reciprocated through O-ring seal 50 by a rack 52, which is driven by an oscillating gear 54 connected to the shaft of an electric drive motor 56 to form a gear motor assembly not shown. The O-ring prevents fluid leakage to the environment.

Housing 32 also contains a second pump 58, comprising a bore 60 which communicates with inlet 36 through a second tandem pair of series-connected inlet check valves (not shown), identical with inlet check valves 38*a* and 38*b*, and a passage 62. Bore 60 also communicates with outlet 42 through passage 64 and a second tandem pair of series-connected outlet check valves 66*a* and 66*b*, identical with and in the same orientation as outlet check valves 46*a* and 46*b*. A second piston 68 reciprocates in bore 60, the open end of piston 68 drawing fluid into bore 60 through passage 62 during a suction stroke and expelling fluid from bore 60 through passage 64 during a pressure stroke. Piston 68 is reciprocated through a second O-ring seal 70 by a second rack 72, which is driven by oscillating gear 54 in opposite phase to rack 52, so that when one piston is in a pressure stroke, the other is in a section stroke, and, thereby, continuous flow is maintained between inlet 36 and outlet 42.

Flexible seals 74 and 76 are located in pistons 48 and 68 between the sliding O-ring seals 50 and 70 and the racks 52 and 72 to isolate the fluid from the environment and to provide barriers to bacterial or viral contamination. The flexible seals also acts as backups in event of O-ring deterioration. To maintain constant pressure within the flexible seals, a shunt passage 78 is provided between the interior volumes of the two flexible piston seals. The total interior volume is constant, so the internal pressure will also be constant, within the variation of temperature. A change of temperature of 10° F. would cause an internal pressure change of less than 2%. Any possible leakage of internal gas past the sliding O-ring seal could be trapped in a downstream accumulator. As an additional defense, the interior of the flexible seal could be filled with an innocuous gas such as carbon dioxide.

The complete fluid injection pump shown in FIG. 6 consists of an assembly of a replaceable pumping module 30 and a gear motor 57, which can be quickly coupled to the module to engage the reciprocating racks 52 and 72. Pumping module 30 is simple and economical to make, and, for blood pump purging, the materials can be resistant to a blood compatible liquid such as saline solution.

The housing can be made of a strong rigid polymer, that is compatible with saline (e.g. polycarbonate or DELRIN). The pistons also can be made of a saline compatible polymer such as Delrin. The drive racks, which are not in contact with saline can be made of metal, (stainless steel) or plastic (DELRIN or nylon). The piston/rack assembly procedure is a relatively simple one in which the piston is pressed into an axial hole in the rack and pinned. The assembly is then lightly machined so that the cylindrical rack and the piston are concentric to a close tolerance.

Figure 7:
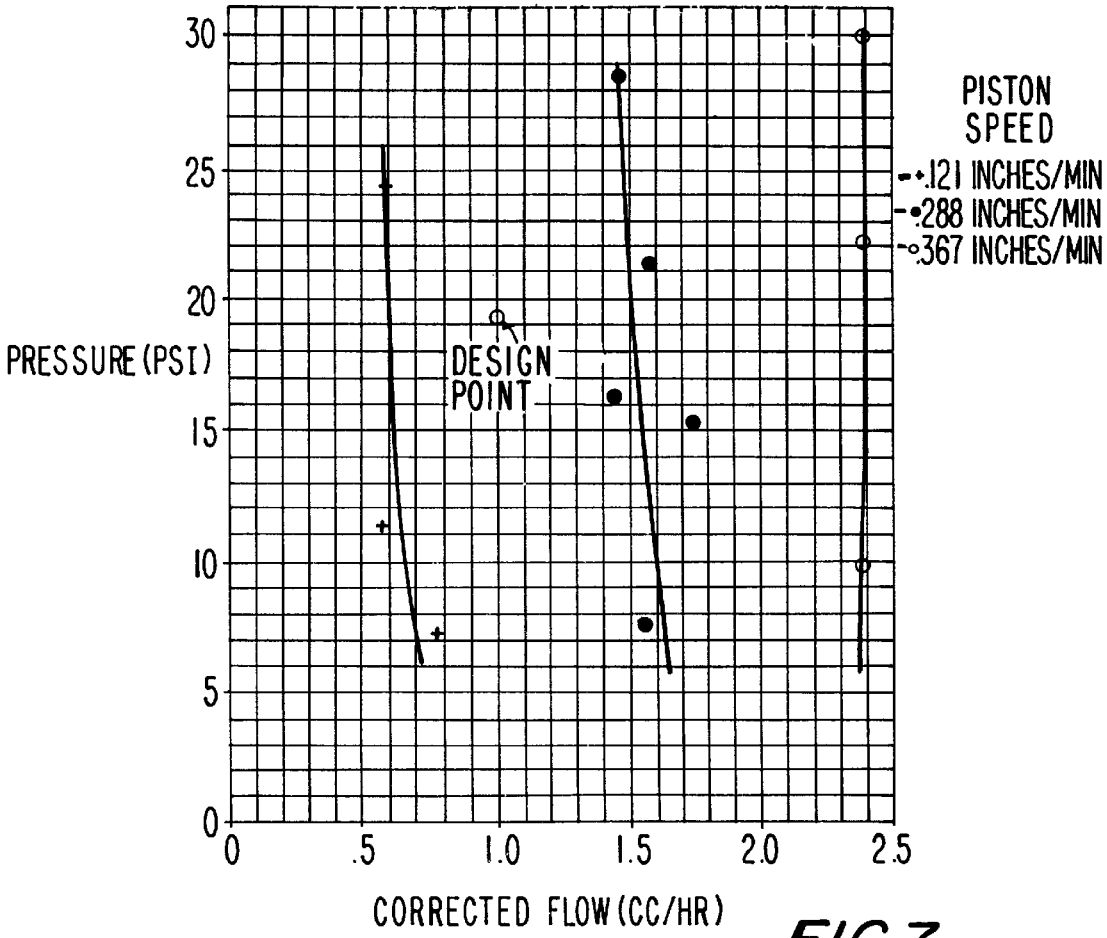
FIG. 7 is a typical performance characteristic of a double-acting fluid injection pump with dual in-line check valves as illustrated in FIGS. 5 and 6, showing the improvement in performance provided by the dual check valves.

FIG. 7 is a plot of test data for a two piston fluid injection pump with dual, series-connected check valves, as shown in FIG. 5 and FIG. 6, showing characteristic performance for blood pump purge application at constant values of motor voltage and piston speed. A drastic improvement is seen over the characteristic of the single check valve injection pump shown in FIG. 4. The dual valve constant voltage (constant speed) curve approaches the vertical characteristic of an ideal displacement pump. The pressure range of interest is taken as being between a lower value of 6 psig, which is based on an accepted specification for arterial infusion of 300 mm Hg, and an upper value of 30 psig, which provides a comfortable margin above the assumed design point of 1000 mm Hg and 1 cc/hr.

When the continuous fluid injection pump is used to supply clean liquid to purge the bearings and seal of a rotary blood pump, purge liquid flow must not be interrupted during operation of the blood pump that is being supplied; otherwise there could be back flow of blood into the seal and bearings. To permit periodic disconnections of the fluid injection pump for maintenance or replacement, and to maintain positive purge liquid flow at a delivery pressure that exceeds the maximum pulsatile blood pressure, a check valve and an accumulator are connected in the delivery line downstream of the pump. The accumulator can have several configurations, but, essentially the delivered purge liquid compresses a volume of air (or other gas) until the air pressure equals the liquid line pressure.

Figure 9:
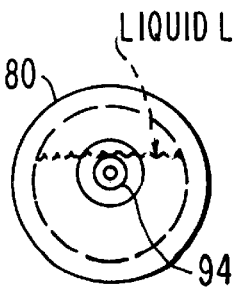
FIG. 9 is an inlet end view of the accumulator assembly shown in FIG. 8.
Figure 8:
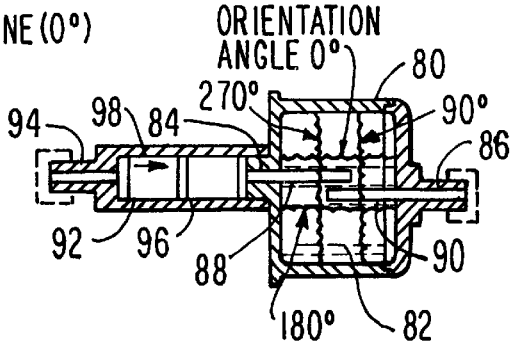
FIG. 8 is an assembly drawing of a non-orientation sensitive accumulator, used in conjunction with the fluid injection pump, and having a check valve, integrated into its inlet.
Figure 10:
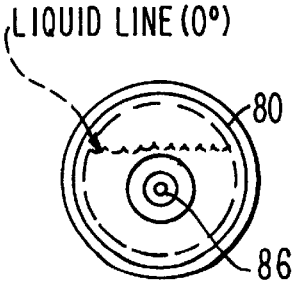
FIG. 10 is an outlet end view of the accumulator assembly shown in FIG. 8.

An accumulator for use with a liquid injection pump in a purge system for a rotary blood pump has been simulated by a vertical standpipe with an open surface. This has the advantage of not requiring a bladder or membrane, but it could only be used in a vertical orientation, which is not suitable for an ambulatory device. Insensitivity to orientation can be achieved by separating the liquid phase from the gas phase with a membrane (bladder, diaphragm), but there is danger that in the event of a leak or rupture of the membrane, in some orientations, gravity could cause the compressed accumulator gas to escape through the outlet into the injection line, and, ultimately, the bloodstream. A non-orientation-sensitive and leak-proof accumulator is desirable for use in a purge system, and such an accumulator is shown in FIGS. 8, 9 and 10. This is similar to a universal air trap, which was part of a controlled fluid transfer system that is described in my co-pending patent application Ser. No. 07/973,958. In the air trap, the inlet and outlet liquid tubes are arranged close to the axis of a symmetrical chamber filled with liquid, with inlet and outlet close to the center of the chamber, and approximately equidistant from the walls. Any bubble that enters through the inlet tube will rise to the prevailing top surface in every orientation and be trapped, so as to prevent passage through the outlet.

A similar principle can be applied to a universal accumulator, except that here, the chamber is pre-filled with a volume of gas, which at standard conditions is too small to escape through the outlet port in any orientation. As pressure increases, this volume is compressed, so that there is decreasing chance of gas escaping through the outlet. The accumulator is filled with an absorbable gas preferably $CO_2$ so that accidental leakage of the gas into the liquid line will not present a serious hazard.

An assembly drawing of a non-orientation sensitive accumulator is shown in FIG. 8. The accumulator comprises housing 80 with an internal cavity 82, an inlet 84 in a wall of the housing, an outlet 86 in a wall of the housing, an inlet tube 82 extending from the inlet to a point slightly beyond the center of the cavity 82, an outlet tube extending from the outlet 86 to a point slightly beyond the center of the cavity 82, a check valve 92 with an inlet 94 and an outlet 96 and a line 98 connecting outlet 96 of check valve 92 to inlet 84 of housing 80. The free surface of the liquid (liquid line) is shown at orientations of 90 degrees apart (0°, 90°, 180°, 270°) to show that the entrance to the outlet tube 90 is always immersed in the liquid. Thus the accumulator can be held in any position while maintaining the same initial gas volume, and without gas leaking into the outlet. Although a patient carrying a cardiac assist pump will not likely be subjected to large linear or angular accelerations, their effect on the accumulator has been examined. Lateral accelerations will cause rotation of the free surface about axes orthogonal to the flow axis, but the center is approximately fixed and the outlet port remains submerged. Acceleration in the axial direction has no effect.

Figure 11:
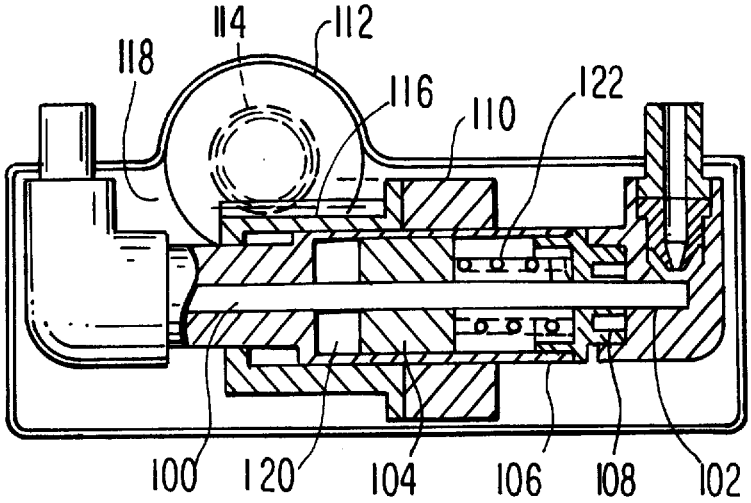
FIG. 11 is an assembly drawing of a hermetically sealed double-acting fluid injection pump with magnetically-driven pistons.

An assembly drawing of a practical, hermetically sealed piston pump with a similar arrangement to that in FIG.1 is shown in FIG. 11. The pistons 100, 102 are the same size as those of FIG. 5, except that instead of being connected to a rack, they are connected to a cylindrical magnet 104 of larger diameter, that is retained within a sealed tube 106. The pistons are separated from the magnet chamber by reciprocating seals 108. A ring magnet 110 rides on the outside of the sealed tube. It is driven by a drive motor 112 and a gear 114 through a rack 116, and it is followed by the cylindrical magnet 104 within tube 106 due to magnetic pull. Drive motor 112, gear 114, rack 116, and the drive magnets are contained in a hermetically sealed chamber 118 that can be filled with an absorbable gas, such as carbon dioxide, to reduce viscous losses. Thus, the elements outside of the piston and follower magnet tube can be protected from any corrosive effects of liquids as well as increased drag due to liquid fill. The follower magnet 104 rides in a chamber 120 that can be filled with clean oil and separated from the (saline) purge liquid by the pistons and the reciprocating piston seals. The drive ring 110 and follower 104 can be rare earth magnets, so that the follower magnet 104 can have a relatively large clearance within tube 106 for low-resistance transfer of the oil from one side of follower magnet 104 to the other. Since follower magnet 104 reciprocates very slowly and does not rotate, it easily can be encased in a ceramic, teflon or other inert material, if needed for protection against a liquid fill, which then could be a dextrose/water solution. It is considered that risks of corrosion would be remote. To eliminate lost motion caused by reversing travel through a point of zero magnetic pull, the enclosed follower magnet 104 is loaded by a spring 122 so that the magnetic pull is always unidirectional.

Figure 12:
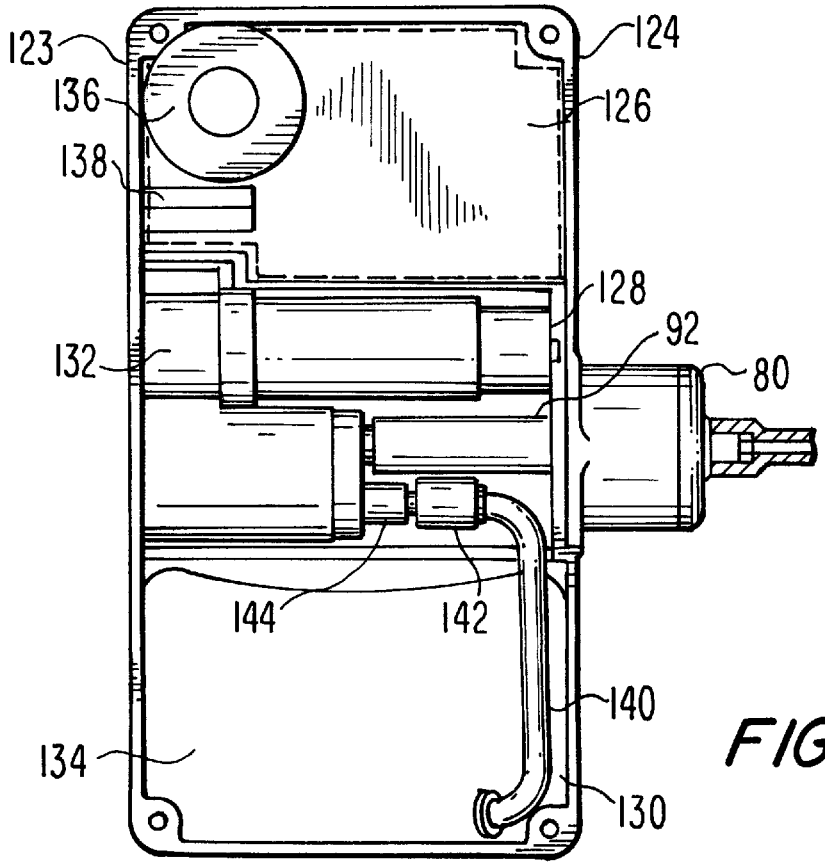
FIG. 12 is an assembly drawing of a representative liquid delivery unit that includes the fluid injection pump shown in FIG. 6 and the accumulator shown in FIG. 8.

A typical arrangement of an integrated unit that incorporates a continuous fluid injection pump and a non-orientation sensitive accumulator for delivery of liquid to purge the rotating seal and bearings of rotary blood pumps is presented in FIG. 12. The unit 123 comprises a housing 124 divided into three compartments, a battery and electronics compartment 126 on top, a pump compartment 128 in the middle, and a liquid reservoir compartment 130 on the bottom. The middle compartment 128 contains a fluid injection pump assembly 132 with dual in-line inlet and outlet valves. The construction is as shown in FIGS. 5 and 6. The bottom compartment 130 could contain a flexible liquid reservoir 134, such as a special polyolefin bag manufactured by Hermac Medical Products, Inc. Buffalo, N.Y. The top compartment 126, could contain a pump power battery 136, such as a BA-5567/U lithium cell, and an electronics battery 138, which could comprise two Panasonic CR2032 cells. A non-orientation sensitive pump outlet accumulator, identical to that shown in FIG. 8, 9 and 10 is shown as an integral component of the assembled unit 133. Accumulator housing 80 is mounted on the exterior of unit housing 124, and it is joined to the outlet of pump assembly 132 through an outlet check valve 92. Reservoir bag 134 provides the liquid to pump assembly 132 through a flexible tube 140, a sterile connector 142, which could be similar to a Beta Cap, and a pump inlet filter 144. With a liquid capacity of reservoir bag 134 of up to 70 cc., the displaced volume of the unit 123 typically could be 300 cc.

What is claimed is:

1. A continuous fluid injection pump to cause a constant flow through a variable load, comprising:

a housing with an inlet and an outlet;

a first bore in said housing;

a first inlet line between said housing inlet and said first bore;

a first outlet line between said housing outlet and said first bore;

a first piston free to reciprocate within said first bore;

means to reciprocate said first piston in a suction stroke and a pressure stroke;

a first inlet valve in said first inlet line, said first inlet valve being open when said first piston is in said suction stroke, drawing fluid in said first bore through said first inlet line, and closed when said first piston is in said pressure stroke;

a first outlet valve in said first outlet line, said first outlet valve being open when said first piston is in said pressure stroke, expelling fluid from said first bore into said first outlet line, and closed when said piston is in said suction stroke;

a first sliding seal in contact with said first piston to, prevent fluid leakage;

a first flexible seal between said first sliding seal and said reciprocating means, said first flexible seal being connected at one end to said first piston and at the other end to said housing, creating a first interior volume to isolate the fluid from the environment, and to prevent bacterial contamination;

a second bore in said housing;

a second inlet line between said housing inlet and said second bore;

a second piston free to reciprocate within said second bore;

means to reciprocate said second piston in a suction stroke and a pressure stroke in opposite phase to said first piston;

a second inlet valve in said second inlet line, said second inlet valve being open when said second piston is in said suction stroke, and closed when said second piston is in said pressure stroke;

a second sliding seal in contact with said second piston;

a second flexible seal between said second sliding seal and said reciprocating means, said second flexible seal being connected at one end to said second piston and at the other end to said housing, creating a second interior volume; and a shunt between said interior volumes of said first and said second flexible seals to equalize the pressures therein.

2. A continuous fluid injection pump to cause a constant flow of fluid through a variable load comprising:

a housing with an inlet, an outlet and a bore;

an inlet line between said housing inlet and said bore;

an outlet line between said housing outlet and said bore;

a piston free to reciprocate within said bore;

means to reciprocate said piston in a suction stroke and a pressure stroke;

an inlet valve in said inlet line, said inlet valve being open when said piston is in said suction stroke, drawing fluid in said bore through said inlet line, and closed when said piston is in said pressure stroke;

an outlet valve in said outlet line, said outlet valve being open when said piston is in said pressure stroke, expelling fluid from said bore into said outlet line, and closed when said piston is in said suction stroke;

a sliding seal in contact with said piston to prevent fluid leakage;

a flexible seal between said sliding seal and said reciprocating means, said flexible seal being connected at one end to said piston and at the other end to said housing, creating an interior volume, to isolate the fluid from the environment, and to prevent bacterial contamination.

* * * * *